US008885836B2

(12) United States Patent
McGrath et al.

(10) Patent No.: US 8,885,836 B2
(45) Date of Patent: Nov. 11, 2014

(54) DECORRELATOR FOR UPMIXING SYSTEMS

(75) Inventors: David S. McGrath, Rose Bay (AU); Mark S. Vinton, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 882 days.

(21) Appl. No.: 13/121,323

(22) PCT Filed: Sep. 28, 2009

(86) PCT No.: PCT/US2009/058590

§ 371 (c)(1), (2), (4) Date: Apr. 28, 2011

(87) PCT Pub. No.: WO2010/039646

PCT Pub. Date: Apr. 8, 2010

(65) Prior Publication Data

US 2012/0128159 A1 May 24, 2012

Related U.S. Application Data

(60) Provisional application No. 61/194,992, filed on Oct. 1, 2008.

(51) Int. Cl.

| | |
|---|---|
| ***H04R 5/00*** | (2006.01) |
| ***H04S 1/00*** | (2006.01) |
| *H04S 3/00* | (2006.01) |
| *H04S 7/00* | (2006.01) |

(52) U.S. Cl.

CPC ..... *H04S 1/002* (2013.01); *H04S 3/002* (2013.01); *H04S 7/307* (2013.01)

USPC ..... 381/20; 381/17; 381/22

(58) Field of Classification Search

CPC ..... H04S 5/00; H04S 5/005; H04S 5/02; H04S 7/30; H04S 2420/07

USPC ..... 381/17, 18, 20

See application file for complete search history.

(56) References Cited

U.S. PATENT DOCUMENTS

| | | | |
|---|---|---|---|
| 4,841,572 | A | 6/1989 | Klayman |
| 6,111,958 | A | 8/2000 | Maher |

(Continued)

FOREIGN PATENT DOCUMENTS

| | | |
|---|---|---|
| CN | 1930915 | 3/2007 |
| CN | 101223820 | 7/2008 |

(Continued)

OTHER PUBLICATIONS

Kendall, Gary S., "The Decorrelation of Audio Signals and Its Impact on Spatial Imagery", Winter 1995, MIT, Computer Music Journal vol. 19:4, pp. 71-87.*

(Continued)

*Primary Examiner* — Davetta W Goins
*Assistant Examiner* — Daniel Sellers

(57) ABSTRACT

An improved decorrelator is disclosed that processes an input audio signal in two separate paths. In one path, a banded phase-flip filter is applied to lower frequencies of the input audio signal. In a second path, a frequency-dependent delay is applied to higher frequencies of the input audio signal. Signals from the two paths are combined to obtain an output signal that is psychoacoustically decorrelated with the input audio signal. The decorrelated signal can be mixed with the input audio signal without generating audible artifacts.

15 Claims, 5 Drawing Sheets

(56) References Cited

U.S. PATENT DOCUMENTS

| | | | | |
|---|---|---|---|---|
| 6,665,409 | B1 | 12/2003 | Rao | |
| 6,760,448 | B1 | 7/2004 | Gundry | |
| 7,076,071 | B2 * | 7/2006 | Katz | 381/307 |
| 7,929,708 | B2 * | 4/2011 | Reams et al. | 381/17 |
| 8,064,624 | B2 * | 11/2011 | Neugebauer et al. | 381/310 |
| 8,284,961 | B2 * | 10/2012 | Miyasaka et al. | 381/119 |
| 8,442,241 | B2 * | 5/2013 | Yamada et al. | 381/98 |
| 2006/0165184 | A1 | 7/2006 | Purnhagen et al. | |
| 2006/0165237 | A1 | 7/2006 | Villemoes | |
| 2007/0038439 | A1 | 2/2007 | Schuijers | |
| 2007/0140499 | A1 | 6/2007 | Davis | |
| 2010/0177903 | A1 * | 7/2010 | Vinton et al. | 381/20 |
| 2012/0128159 | A1 * | 5/2012 | McGrath et al. | 381/17 |

FOREIGN PATENT DOCUMENTS

| | | |
|---|---|---|
| EP | 1845699 | 10/2007 |
| EP | 1906705 | 4/2008 |
| JP | S61-271000 | 12/1986 |
| WO | 9120167 | 12/1991 |
| WO | 9528034 | 10/1995 |
| WO | 9912386 | 3/1999 |
| WO | WO 03/07656 | 1/2003 |
| WO | 2005091678 | 9/2005 |
| WO | 2006/026452 | 3/2006 |
| WO | WO 2007106551 A1 * | 9/2007 |
| WO | 2007118583 | 10/2007 |
| WO | 2008/153944 | 12/2008 |
| WO | 2009/102750 | 8/2009 |

OTHER PUBLICATIONS

Gundry, Kenneth, "A New Active Matrix Decoder for Surround Sound", AES 19th International Conference, May 2001, pp. 2-9.

Seefeldt, et al., "New Techniques in Spatial Audio Coding" AES Convention Paper 6587, presented at the 119th Convention, Oct. 7-10, 2005, New York, USA. pp. 1-13.

Breebaart, et al., "MPEG Spatial Audio Coding/MPEG Surround: Overview and Current Status" AES Convention Paper 6599, presented at the 119th Convention Oct. 7-10, 2005, New York, USA, pp. 1-17.

Potard, et al., "Decorrelation Techniques for the Rendering of Apparent Sound Source width in 3D Audio Displays" Proceedings of the International Conference on Digital Audioeffects, Oct. 5, 2004, pp. 280-284.

Benesty, et al., "Stereophonic Acoustic Echo Cancellation Using Nonlinear Transformations and Comb Filtering" Acoustics, Speech and Signal Processing, 1998, Proceedings of the 1998 IEEE International Conference on Seattle, WA, May 12-15, 1998, New York, NY. vol. 6, pp. 3673-3676.

* cited by examiner

DECORRELATOR FOR UPMIXING SYSTEMS

TECHNICAL FIELD

The present invention relates to decorrelation techniques that may be used to improve the performance of so-called "upmixing" devices that generate multiple audio signals from a set of fewer audio signals.

BACKGROUND ART

Techniques for generating multiple audio signals from a set of fewer audio signals have been developed for many years and are used in a variety of upmixing devices such as the Dolby Pro Logic II decoder described in Gundry, "A New Active Matrix Decoder for Surround Sound," 19th AES Conference, May 2001. The perceived performance of the upmixing devices can generally be improved by decorrelation because at least some degree of decorrelation in the upmixed signals generally increases the perceived width of the aural image achieved by playback of the upmixed signals. Decorrelation can be obtained in a variety of known ways including simple delays and more complicated all-pass lattice filters.

Many conventional upmixing devices use one or more matrix structures to derive a number M output audio signals from a number N input audio signals, where N is less than M. Some devices use active or variable matrix structures that are adapted in response to control signals derived from the input audio signals. When decorrelation is used, an active matrix structure is sometimes divided into two stages. The first stage derives 2M intermediate signals from the N input audio signals and the second stage derives the M output audio signals from the 2M intermediate signals. A decorrelation technique is applied to half of the 2M intermediate signals. The second stage generates output audio signals with varying degrees of correlation by mixing amounts of non-decorrelated and decorrelated signals that are adapted in response to the control signals.

The choice of decorrelation technique can have a profound effect on the performance of an upmixing device. The inventors have determined that the performance of an upmixing device can be improved significantly if the decorrelation technique can satisfy three requirements simultaneously: provide a decorrelated signal that does not sound significantly different from the non-decorrelated signal, provide a sufficient amount of decorrelation to ensure the decorrelated signal sounds discrete or distinct with respect to the non-decorrelated signal, and allow mixing of the decorrelated signal and the non-decorrelated signal without generating audible artifacts. An additional advantage of such a technique is that the upmixed signals can be downmixed to a fewer number of input audio signals without generating objectionable artifacts.

DISCLOSURE OF INVENTION

It is an object of the present invention to provide for psychoacoustically decorrelated signals that do not sound distorted, have a sufficient amount of decorrelation to ensure the psychoacoustically decorrelated signals sound discrete or distinct with respect to the input audio signals, and allow mixing of the psychoacoustically decorrelated signals and non-decorrelated signals without generating audible artifacts.

The present invention is directed toward achieving a type of decorrelation that is referred herein as psychoacoustical decorrelation, which is related to but differs from conventional numerical correlation. The numerical correlation of two signals can be calculated using a variety of known numerical algorithms. These algorithms yield a measure of numerical correlation called a correlation coefficient that varies between negative one and positive one. A correlation coefficient with a magnitude equal to or close to one indicates the two signals are closely related. A correlation coefficient with a magnitude equal to or close to zero indicates the two signals are generally independent of each other.

Psychoacoustical correlation refers to correlation properties of audio signals that exist across frequency subbands that have a so-called critical bandwidth. The frequency-resolving power of the human auditory system varies with frequency throughout the audio spectrum. The human ear can discern spectral components closer together in frequency at lower frequencies below about 500 Hz but not as close together as the frequency progresses upward to the limits of audibility. The width of this frequency resolution is referred to as a critical bandwidth and, as just explained, it varies with frequency.

Two signals are psychoacoustically decorrelated if the average numerical correlation coefficient across a critical bandwidth is equal to or close to zero. The correlation coefficient need not be equal to or close to zero at all frequencies but, if it does have a magnitude that departs significantly from zero at some frequencies, the numerical correlation must vary in such a way that the average numerical correlation coefficient in a critical bandwidth is equal to or close to zero.

The object stated above is achieved by the invention as set forth in the independent claims. Advantageous implementations are set forth in the dependent claims.

Features of the present invention and its preferred implementations may be better understood by referring to the following discussion and the accompanying drawings. The contents of the following discussion and the drawings are set forth as examples only and should not be understood to represent limitations upon the scope of the present invention.

MODES FOR CARRYING OUT THE INVENTION

A. Introduction

Figure 1:
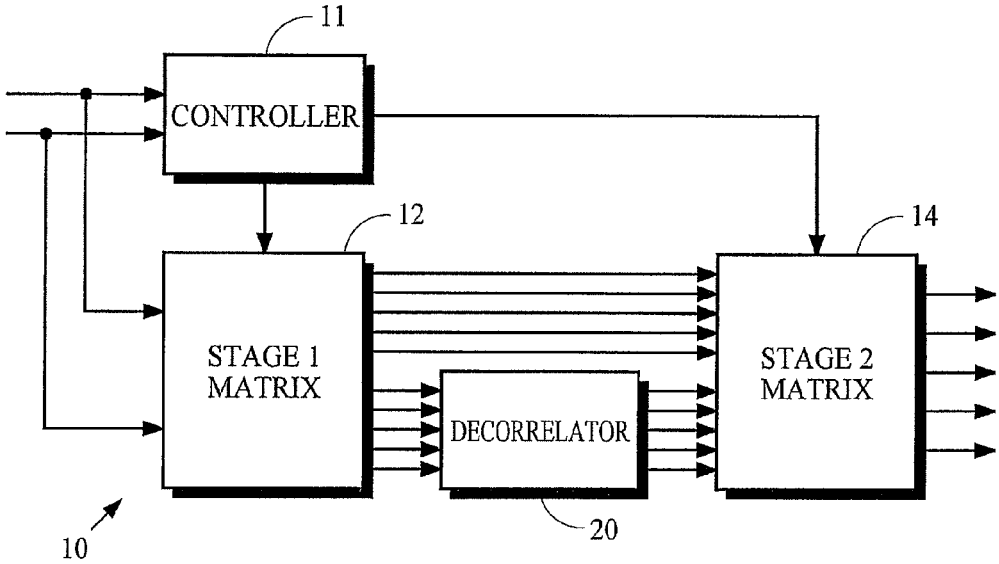
FIG. 1 is a schematic block diagram of an exemplary upmixing device.

FIG. 1 is a schematic block diagram of one upmixing device 10 that incorporates various aspects of the present invention. The device 10 receives N input audio signals and upmixes them into M output audio signals, where M>N. In the example shown in the figure, N=2 and M=5. The stage-1 matrix 12 generates 2M intermediate signals in response to the N input audio signals. The decorrelator 20 processes one half of the 2M intermediate signals to generate M decorrelated intermediate signals, and the stage-2 matrix generates M output audio signals in response to the M decorrelated intermediate signals and the M non-decorrelated intermediate signals. When the decorrelator 20 is implemented according to teachings of the present invention, it provides psychoacoustically decorrelated signals that do not sound significantly different from the non-decorrelated input signals, it provides a sufficient amount of psychoacoustical decorrelation to ensure the decorrelated signals sound discrete or distinct with respect to the non-decorrelated input signals, and it allows mixing of the decorrelated signals and the non-decorrelated input signals without generating audible artifacts. The controller 11 generates control signals in response to the N input audio signals that are used to adapt the operation of the stage-1 matrix 12 and the stage-2 matrix 14. Additional information about the implementation and adaptation of these matrices may be obtained from international patent application no. PCT/US 2005/030453 entitled "Multichannel Decorrelation in Spatial Audio Coding" published 9 Mar. 2006 as publication no. WO 2006/026452 A1, and J. Breebaart et al., "MPEG Spatial Audio Coding/MPEG Surround Overview and Current Status," AES 119th Convention, New York, October 2005.

Figure 2:
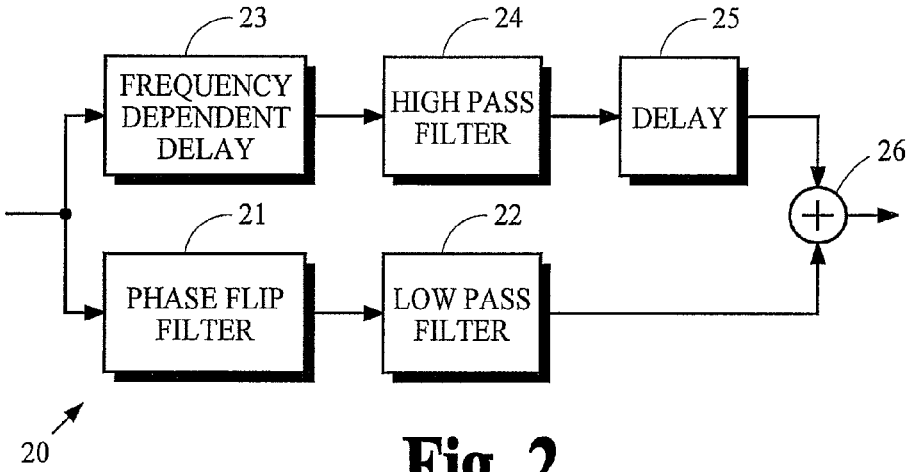
FIG. 2 is a schematic block diagram of a decorrelator.

FIG. 2 is a schematic block diagram of one implementation of a portion of the decorrelator 20 that processes one of the intermediate signals. An input intermediate signal is passed along two different signal-processing paths. The lower-frequency path includes a phase-flip filter 21 and a low pass filter 22. The higher-frequency path includes a frequency-dependent delay 23, a high pass filter 24 and a delay component 25. The outputs of the delay 25 and the low pass filter 22 are combined in the summing node 26. The output of the summing node 26 is a decorrelated intermediate signal that is psychoacoustically decorrelated with respect to the input intermediate signal.

The cut off frequencies of the low pass filter 22 and the high pass filter 24 should be chosen so that there is no gap between the passbands of the two filters and so that the spectral energy of their combined outputs in the region near the crossover frequency where the passbands overlap is substantially equal to the spectral energy of the input intermediate signal in this region. The amount of delay imposed by the delay 25 should be set so that the propagation delay of the higher-frequency and lower-frequency signal processing paths are approximately equal at the crossover frequency.

The decorrelator 20 may be implemented in different ways. Even the exemplary implementation shown in the figure may be modified. For example, either one or both of the low pass filter 22 and the high pass filter 24 may precede the phase-flip filter 21 and the frequency-dependent delay 23, respectively. The delay 25 may be implemented by one or more delay components placed in the signal processing paths as desired.

The illustrated implementations of the decorrelator 20 electrically combines the signals from the two signal-processing paths; however, these signals may be combined in other ways. In one alternative implementation, the two signals are combined acoustically. This may be done by omitting the summing node 26 from the device 20 and processing the signals from the higher-frequency and lower-frequency signal processing paths separately in the stage-2 matrix 24. The stage-2 matrix 24 can generate a lower-frequency band signal and higher-frequency band signal for each of its M output audio signals to drive different acoustic transducers, which allows these signals to be combined acoustically.

B. Lower-Frequency Processing Path

1. Banded Phase-Flip Filter

Figure 3:
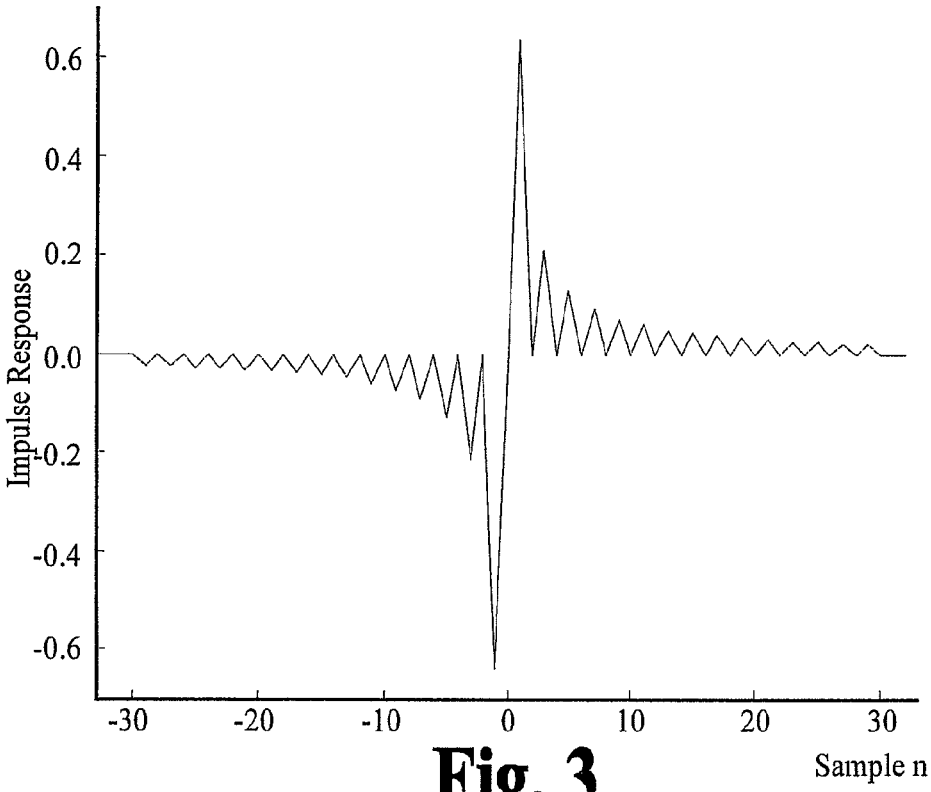
FIG. 3 is graphical illustration of the impulse response of an exemplary Hilbert transform.

An ideal implementation of the phase-flip filter 21 has a magnitude response of unity and a phase response that alternates or flips between positive ninety degrees and negative ninety degrees at the edges of two or more frequency bands within the passband of the filter. This banded phase flip filter 21 may be viewed as an extension of the Hilbert transform. The impulse response of the Hilbert transform is shown in the following equation and illustrated in FIG. 3:

$$H(k) = \begin{cases} 2/k\pi & \{\text{odd } k\} \\ 0 & \{\text{even } k\} \end{cases} \tag{1}$$

Figure 4:
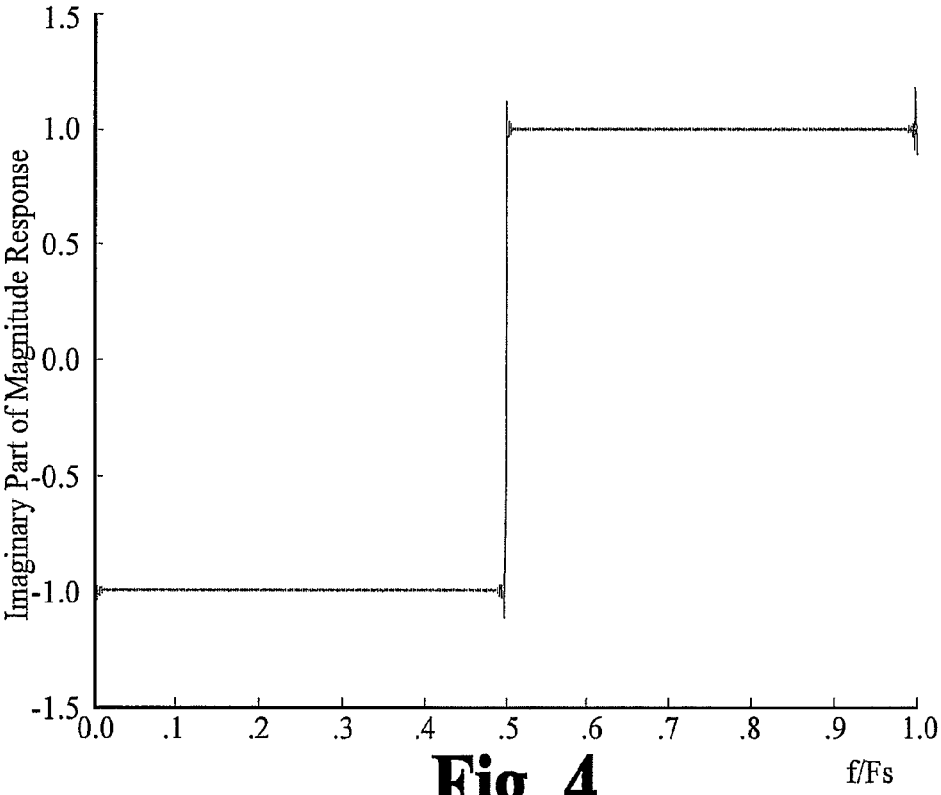
FIG. 4 is a graphical illustration of the imaginary part of a complex frequency response of an exemplary Hilbert transform.

Because the impulse response of the Hilbert transform is an odd-symmetric response, the frequency response of the transform is a complex function of frequency that is purely imaginary. This frequency response, expressed as a function of normalized frequency f/Fs, where Fs is the sample frequency, is illustrated in FIG. 4. When a Hilbert transform is applied to a signal, it imparts a negative ninety degree phase shift to positive frequencies and a positive ninety degree phase shift to negative frequencies. Although the phase-flip filter 21 could be implemented by the Hilbert transform, this implementation would not be satisfactory because its decorrelated output signal does not sound discrete or distinct with respect to the audio signal that is input to the transform.

This deficiency may be overcome by implementing the phase-flip filter 12 with a sparse Hilbert transform that has the impulse response shown in the following equation:

$$H_s(k) = \begin{cases} 2/k'\pi & \{\text{odd } k' = k/S\} \\ 0 & \{\text{otherwise}\} \end{cases} \tag{2}$$

Figure 5:
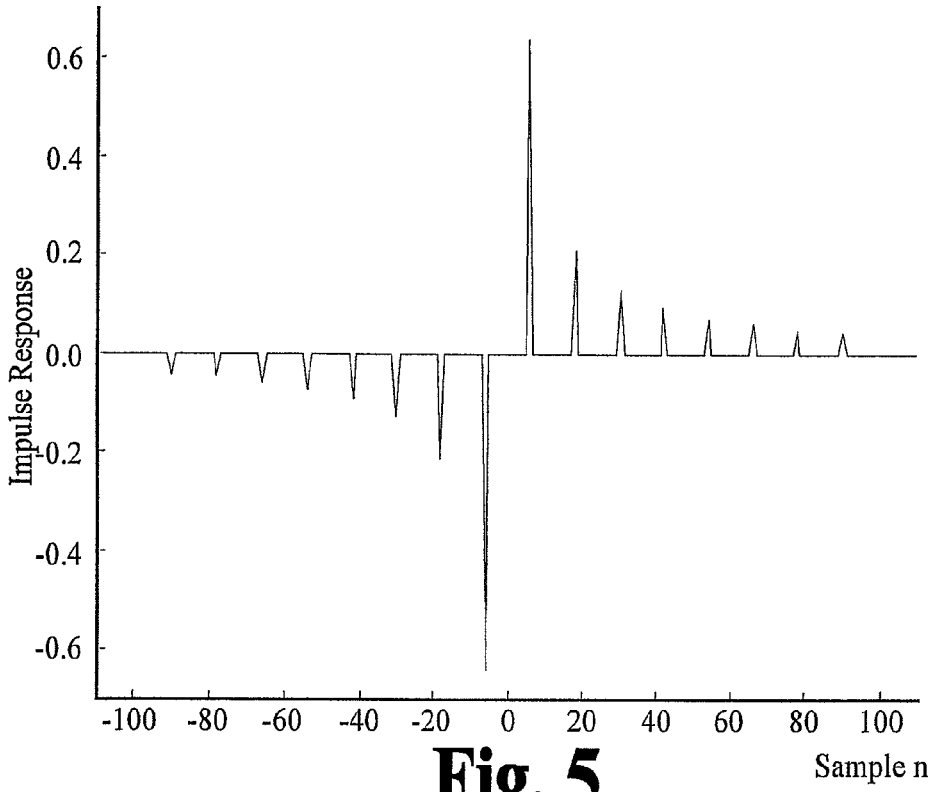
FIG. 5 is a graphical illustration of the impulse response of an exemplary sparse Hilbert transform.
Figure 6:
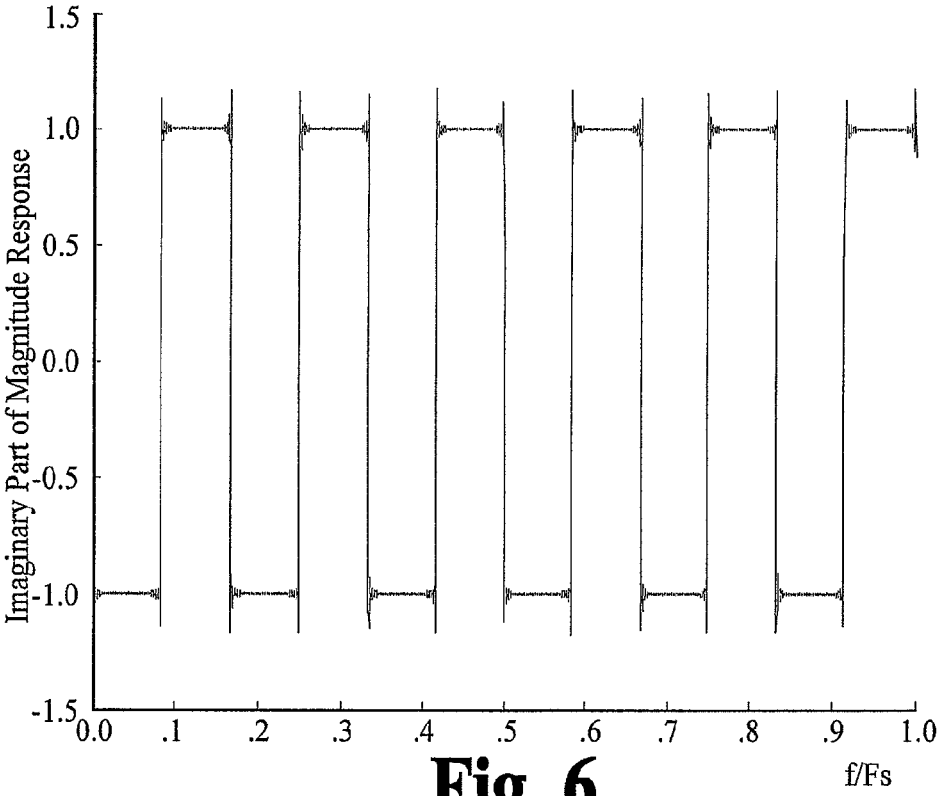
FIG. 6 is a graphical illustration of the imaginary part of a complex frequency response of an exemplary sparse Hilbert transform.

The impulse response of the sparse Hilbert transform, with S=6, is illustrated in FIG. 5. This impulse response also is an odd-symmetric response; therefore, the frequency response of this sparse transform is a complex function that is purely imaginary. The frequency response is illustrated in FIG. 6. The phase response flips between positive and negative ninety degrees several times. The interval between adjacent flips is equal to Fs/2S.

When implemented by a sparse Hilbert transform, the phase-flip filter 21 provides a decorrelated signal that generally does not sound distorted, has a sufficient amount of decorrelation to ensure it sounds discrete or distinct with respect to the input signal, and can be mixed with the input signal without generating audible artifacts. For practical implementations, however, the impulse response of the sparse Hilbert transform must be truncated. The length of the truncated response can be selected to optimize decorrelator performance by balancing a tradeoff between transient performance and smoothness of the frequency response.

On one hand, the impulse response should be short enough to provide good transient performance. If the impulse response is too long, transients will be audibly smeared in the decorrelated output signal.

Figure 7:
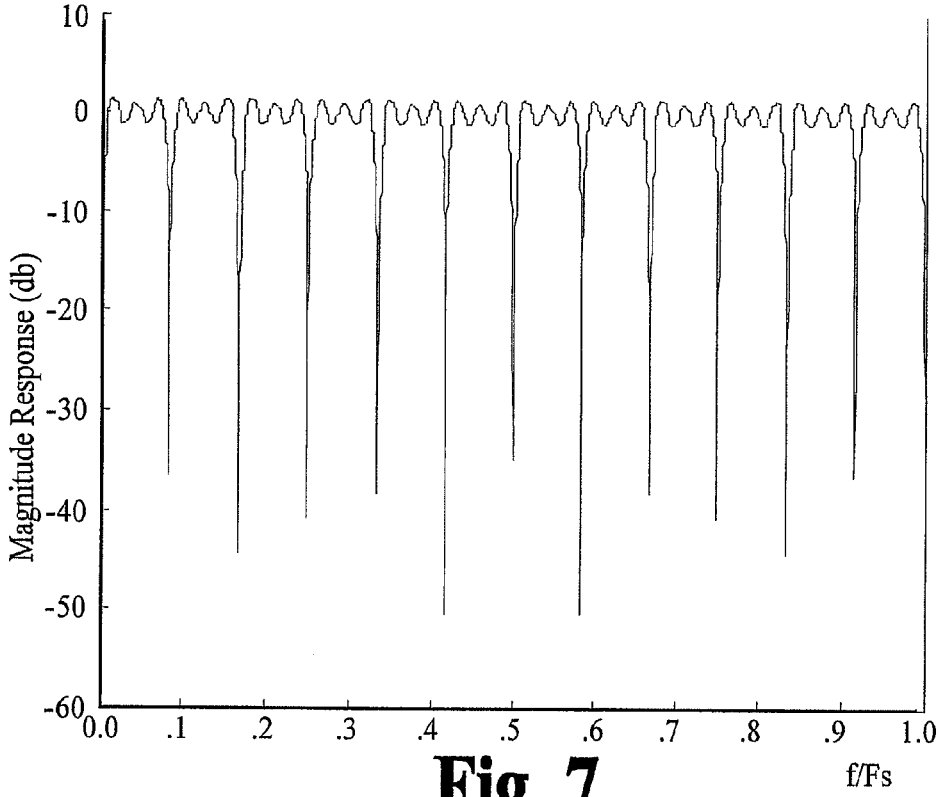
FIG. 7 is a graphical illustration of a frequency-domain magnitude response of an exemplary truncated sparse Hilbert transform.

On the other hand, the impulse response should be long enough to provide a reasonably smooth magnitude for its frequency response. FIG. 7 illustrates the frequency-domain magnitude response of a sparse Hilbert transform with S=6 and a truncated impulse response with six non-zero coefficients. The magnitude response contains notches at those frequencies where the phase flips occur. The width of these notches is inversely related to the length of the impulse response of the sparse Hilbert transform. The notches become narrower as the impulse response is lengthened. If the notches are too wide, the phase-flip filter 21 will generate annoying artifacts in its decorrelated output signal.

The number of phase flips is controlled by the value of the S parameter. This parameter should be chosen to balance a tradeoff between the degree of decorrelation and the impulse response length. A longer impulse response is required as the S parameter value increases. If the S parameter value is too small, the filter provides insufficient decorrelation. If the S parameter is too large, the filter will smear transient sounds over an interval of time sufficiently long to create objectionable artifacts in the decorrelated signal as discussed above.

The ability to balance these characteristics can be improved by implementing the phase-flip filter 21 to have a non-uniform spacing in frequency between adjacent phase flips, with a narrower spacing at lower frequencies and a wider spacing at higher frequencies. This implementation can provide on one hand narrower notches in the frequency-domain magnitude response and more time smearing at lower frequencies, and can provide on the other hand wider notches in the frequency-domain magnitude response and less time smearing at higher frequencies. This implementation is preferred because it has been found that the effects of time smearing is less noticeable at low frequencies and more noticeable at high frequencies, and the effects of widely-spaced notches are more noticeable at low frequencies but less noticeable at high frequencies.

Figure 8:
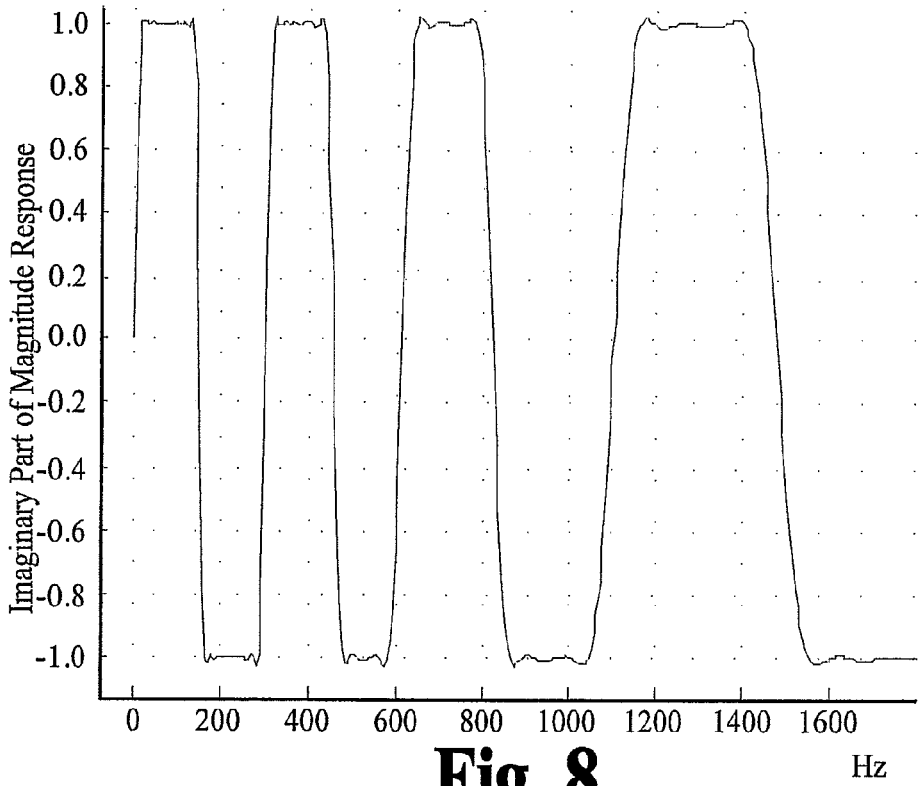
FIG. 8 is a graphical illustration of the imaginary part of a complex frequency response of an exemplary phase-flipping filter.
Figure 9:
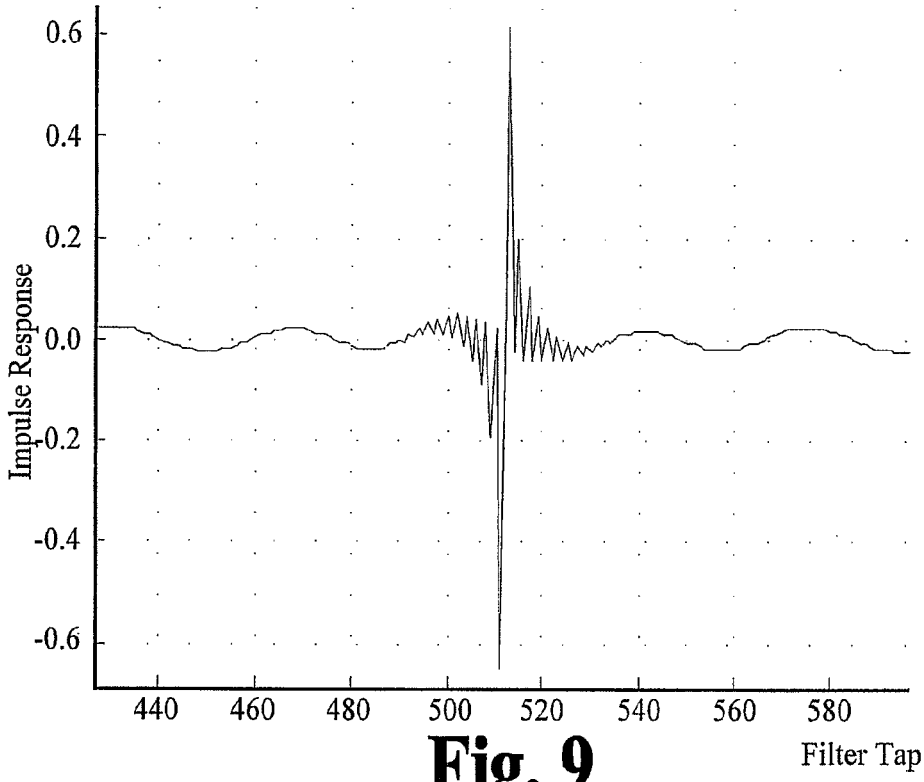
FIG. 9 is a graphical illustration of the impulse response of an exemplary phase-flipping filter.

In a preferred implementation of the phase-flip filter 21, the spacing between adjacent phase flips is a logarithmic function of frequency. One example is illustrated in FIG. 8. The corresponding impulse response is illustrated in FIG. 9. This filter can be implemented as a finite impulse response (FIR) filter with an impulse response obtained by: (1) generating a function such as that shown in FIG. 8 with smooth interpolations for the transitions between the function values of positive one and negative one; (2) creating a complex-valued frequency response having a real part equal to zero and an imaginary part equal to the function generated in the first step; and (3) applying an inverse Fourier transform to the complex-valued frequency response to generate the impulse response. Preferably, the filter is implemented by fast convolution.

A notch exists in the frequency response for each transition in the phase response. The preferred implementation has a frequency response with notches having widths that are the greater of approximately 20 Hz or one-tenth an octave.

The phase-flip response may be illustrated by a complex-valued phasor that is aligned with the imaginary axis and flips between one orientation along the positive imaginary axis and a second orientation along the negative imaginary axis. The phasor passes through zero when it flips between orientations, which indicates the filter gain is zero at these instants. This accounts for the notches in the frequency response.

An alternative implementation can use a different phasor trajectory that follows the unit circle. This describes the frequency response of an all-pass filter. This filter can be implemented as an FIR filter with an impulse response obtained by: (1) generating a function such as that shown in FIG. 8 with smooth interpolations for the transitions between the function values of positive one and negative one; (2) creating a complex-valued frequency response with a magnitude equal to one and a phase response in degrees equal to the function generated in the first step multiplied by ninety so that the phase makes transitions between positive ninety and negative ninety degrees; and (3) applying an inverse Fourier transform to the complex-valued frequency response to generate the impulse response. Preferably, the filter is implemented by fast convolution.

The important characteristic of this as well as any other implementation of the phase-flip filter 21 is that the resulting filter has a bimodal distribution in frequency of its phase response with peaks substantially equal to positive and negative ninety degrees. A peak is said to be substantially equal to some nominal angle if it is within ten degrees. The frequency interval of the transitions between these two values should be relatively small, and the frequency interval between adjacent transitions should be small compared to the passband of the filter.

This FIR filter and the Hilbert transform filters discussed above are not causal. In a practical implementation, the non-causal property is achieved with the use of a delay. This delay should be accounted for in the higher-frequency path to keep the signals in these two paths aligned in time so that they can be combined properly by the summing node 26. The non-causal delay should also be accounted for in signal paths that do not pass through the decorrelator 20.

2. Low Pass Filter

The phase-flip filter 21 provides good decorrelation performance of audio signals up to approximately 2.5 kHz. Another mechanism that is discussed below is used for higher frequencies. A frequency limit can be imposed on the phase-flip filter 21 in a variety of ways including the use of a low pass filter applied to its output, a low pass filter applied to its input, or a modified design that incorporates the desired low-pass characteristic in the phase-flip filter itself. Conventional linear filter design techniques may be used to obtain the modified design.

C. Higher-Frequency Processing Path

1. Frequency-Dependent Delay

A process that delays an input signal and combines the delayed signal with the non-delayed input signal operates like a comb-filter that generates an output signal with notches in its spectrum. These notches produce annoying distortions in the combined output signal. The frequency dependent delay 23 avoids this problem by imposing a delay that decreases with increasing frequency. The frequency-dependent delay produces a non-uniform spacing between adjacent notches in the spectrum of the combined output signal, which can reduce the audibility of artifacts produced by these notches for higher frequencies.

The frequency dependent delay 23 may be implemented by a filter that has an impulse response equal to a finite length sinusoidal sequence h[n] whose instantaneous frequency decreases monotonically from π to zero over the duration of the sequence. This sequence may be expressed as:

$$h[n]=G\sqrt{|\omega'(n)|}\cos(\phi(n)),\text{for } 0\leq n<L \tag{3}$$

where

ω(n)=the instantaneous frequency;

ω'(n)=the first derivative of the instantaneous frequency;

G=normalization factor;

$\phi(n)=\int_0^n \omega(t)\,dt$=instantaneous phase; and

L=length of the delay filter.

The normalization factor G is set to a value such that:

$$\sum_{n=0}^{L-1} h^2[n] = 1 \tag{4}$$

A filter with this impulse response can sometimes generate "chirping" artifacts when it is applied to audio signals with transients. This effect can be reduced by adding a noise-like term to the instantaneous phase term as shown in the following equation:

$$h[n]=G\sqrt{|\omega'(n)|}\cos(\phi(n)+N(n)),\text{for } 0\le n<L \tag{5}$$

If the noise-like term is a white Gaussian noise sequence with a variance that is a small fraction of π, the artifacts that are generated by filtering transients will sound more like noise rather than chirps and the desired relationship between delay and frequency is still achieved.

2. High Pass Filter

The frequency dependent delay 23 provides good decorrelation performance of audio signals for frequencies above approximately 2.5 kHz. A frequency limit can be imposed on the frequency dependent delay 23 in a variety of ways including the use of a high pass filter applied to its output, a high pass filter applied to its input, or a modified design that incorporates the desired high-pass characteristic in the frequency dependent delay filter itself. Conventional linear filter design techniques may be used to obtain the modified design.

3. Delay

It is anticipated that in some implementations the group delay of the phase-flip filter 21 will exceed the minimum delay of the frequency delay 23 at the highest frequency of interest. The delay 25 is provided in the higher-frequency path to account for the excess delay so that the signals in the two paths can be combined to provide a decorrelated signal across the frequency band of interest. This delay can be inserted anywhere in the higher-frequency path. Alternatively, the frequency dependent delay 23 can be designed to provide the appropriate amount of delay.

D. Implementation

Devices that perform the processes for the processing paths may be designed in a variety of ways including discrete components for each process, an FIR filter for each of the processing paths, and a single composite FIR filter. The impulse response for this composite filter may be obtained by implementing each processing path as a separate time-domain to frequency-domain transform, combining the frequency-domain responses of the two transforms, and obtaining the impulse response of the composite filter by applying a frequency-domain to time-domain transform to the combined frequency-domain responses.

Figure 10:
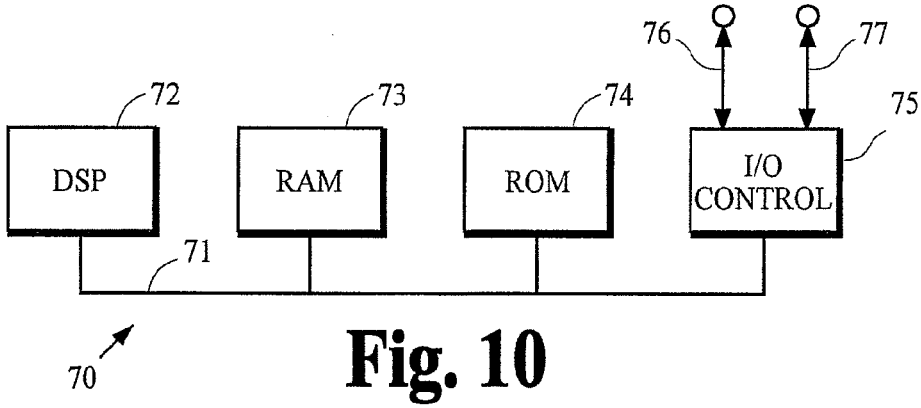
FIG. 10 is a schematic block diagram of a device that may be used to implement various aspects of the present invention.

These devices may be implemented in a variety of ways including software for execution by a computer or some other device that includes more specialized components such as digital signal processor (DSP) circuitry coupled to components similar to those found in a general-purpose computer. FIG. 10 is a schematic block diagram of a device 70 that may be used to implement aspects of the present invention. The DSP 72 provides computing resources. Random access memory (RAM) 73 is used by the DSP 72 for processing. ROM 74 represents some form of persistent storage such as read only memory (ROM) for storing programs needed to operate the device 70 and possibly for carrying out various aspects of the present invention. Input/output (I/O control 75 represents interface circuitry to receive and transmit signals by way of the communication channels 76, 77. In the embodiment shown, all major system components connect to the bus 71, which may represent more than one physical or logical bus; however, a bus architecture is not required to implement the present invention.

In embodiments implemented by a general purpose computer system, additional components may be included for interfacing to devices such as a keyboard or mouse and a display, and for controlling a storage device 78 having a storage medium such as magnetic tape or disk, or an optical medium. The storage medium may be used to record programs of instructions for operating systems, utilities and applications, and may include programs that implement various aspects of the present invention.

These devices may also be implemented by discrete logic components, integrated circuits, one or more ASICs and/or program-controlled processors. The manner in which these devices are implemented is not important to the present invention.

Software implementations of the present invention may be conveyed by a variety of machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media including paper.

The invention claimed is:

1. A method for decorrelating an input audio signal that comprises:

filtering the input audio signal according to a first impulse response in a first frequency subband to generate a first subband signal that represents the input audio signal in the first frequency subband with a frequency-dependent change in phase having a bimodal distribution in frequency with peaks substantially equal to positive and negative ninety-degrees, and according to a second impulse response in a second frequency subband to generate a second subband signal that represents the input audio signal in the second frequency subband with a frequency-dependent delay, wherein:

the second impulse response is not equal to the first impulse response, the second frequency subband includes frequencies that are higher than frequencies included in the first frequency subband, the first frequency subband includes frequencies that are lower than frequencies included in the second frequency subband;

the first impulse response represents a banded phase-flip filter in cascade with a low-pass filter; and the second impulse response represents a frequency-dependent delay in cascade with a high-pass filter; and generating an output signal that represents a combination of the first subband signal and the second subband signal, and has a measure of mathematical correlation with the input audio signal that varies over frequency and has averages across perceptual subbands that are closer to zero than averages across narrower bandwidths.

2. The method of claim 1, wherein the high-pass filter and the low-pass filter each have a cutoff frequency within the range from 1 kHz to 5 kHz.

3. The method of claim 1, wherein the second impulse response comprises a finite-length sinusoidal sequence.

4. The method of claim 1, wherein the frequency-dependent change in phase has transitions between positive and negative changes in phase at a plurality of frequencies within the second frequency subband.

5. The method of claim 4, wherein the transitions are separated by frequency intervals having a width that is substantially equal to 150 Hz or 0.415 octave, whichever is greater.

6. An apparatus for decorrelating an input audio signal that comprises:

means for filtering the input audio signal according to a first impulse response in a first frequency subband to generate a first subband signal that represents the input audio signal in the first frequency subband with a frequency-dependent change in phase having a bimodal distribution in frequency with peaks substantially equal to positive and negative ninety-degrees, and according to a second impulse response in a second frequency subband to generate a second subband signal that represents the input audio signal in the second frequency subband with a frequency-dependent delay, wherein:

the second impulse response is not equal to the first impulse response, the second frequency subband includes frequencies that are higher than frequencies included in the first frequency subband, and the first frequency subband includes frequencies that are lower than frequencies included in the second frequency subband;

the first impulse response represents a banded phase-flip filter in cascade with a low-pass filter; and the second impulse response represents a frequency-dependent delay in cascade with a high-pass filter;

means for generating an output signal that represents a combination of the first subband signal and the second subband signal, and has a measure of mathematical correlation with the input audio signal that varies over frequency and has averages across perceptual subbands that are closer to zero than averages across narrower bandwidths.

7. The apparatus of claim 6, wherein the high-pass filter and the low-pass filter each have a cutoff frequency within the range from 1 kHz to 5 kHz.

8. The apparatus of claim 6, wherein the second impulse response comprises a finite-length sinusoidal sequence.

9. The apparatus of claim 6, wherein the frequency-dependent change in phase has transitions between positive and negative changes in phase at a plurality of frequencies within the second frequency subband.

10. The apparatus of claim 9, wherein the transitions are separated by frequency intervals having a width that is substantially equal to 150 Hz or 0.415 octave, whichever is greater.

11. A non-transitory medium recording a program of instructions that is executable by a device to perform a method for decorrelating an input audio signal, wherein the method comprises:

filtering the input audio signal according to a first impulse response in a first frequency subband to generate a first subband signal that represents the input audio signal in the first frequency subband with a frequency-dependent change in phase having a bimodal distribution in frequency with peaks substantially equal to positive and negative ninety-degrees, and according to a second impulse response in a second frequency subband to generate a second subband signal that represents the input audio signal in the second frequency subband with a frequency-dependent delay, wherein:

the second impulse response is not equal to the first impulse response, the second frequency subband includes frequencies that are higher than frequencies included in the first frequency subband, and the first frequency subband includes frequencies that are lower than frequencies included in the second frequency subband;

the first impulse response represents a banded phase-flip filter in cascade with a low-pass filter; and the second impulse response represents a frequency-dependent delay in cascade with a high-pass filter;

generating an output signal that represents a combination of the first subband signal and the second subband signal, and has a measure of mathematical correlation with the input audio signal that varies over frequency and has averages across perceptual subbands that are closer to zero than averages across narrower bandwidths.

12. The non-transitory medium of claim 11, wherein the high-pass filter and the low-pass filter each have a cutoff frequency within the range from 1 kHz to 5 kHz.

13. The non-transitory medium of claim 11, wherein the second impulse response comprises a finite-length sinusoidal sequence.

14. The non-transitory medium of claim 11, wherein the frequency-dependent change in phase has transitions between positive and negative changes in phase at a plurality of frequencies within the second frequency subband.

15. The non-transitory medium of claim 14, wherein the transitions are separated by frequency intervals having a width that is substantially equal to 150 Hz or 0.415 octave, whichever is greater.

* * * * *